US008071016B2

(12) United States Patent
Campbell et al.

(10) Patent No.: US 8,071,016 B2
(45) Date of Patent: Dec. 6, 2011

(54) THIN WALLED POWDER METAL COMPONENT MANUFACTURING

(75) Inventors: Timothy M. Campbell, Hartland, WI (US); Joel H. Mandel, Hartford, WI (US); Donald J. Phillips, Menomonee Falls, WI (US); Donald D. Cooper, Fond du Lac, WI (US); Henry J. Knott, Ypsilanti, MI (US)

(73) Assignee: GKN Sinter Metals LLC, Auburn Hills, MI (US)

( * ) Notice: Subject to any disclaimer, the term of this patent is extended or adjusted under 35 U.S.C. 154(b) by 437 days.

(21) Appl. No.: 12/442,253

(22) PCT Filed: Sep. 21, 2007

(86) PCT No.: PCT/US2007/079198

§ 371 (c)(1), (2), (4) Date: Mar. 20, 2009

(87) PCT Pub. No.: WO2008/036926

PCT Pub. Date: Mar. 27, 2008

(65) Prior Publication Data

US 2010/0086429 A1 Apr. 8, 2010

Related U.S. Application Data

(60) Provisional application No. 60/826,615, filed on Sep. 22, 2006, provisional application No. 60/957,606, filed on Aug. 23, 2007.

(51) Int. Cl.

| | |
|---|---|
| ***B22F 3/14*** | (2006.01) |
| ***B22F 1/00*** | (2006.01) |
| ***B22F 3/02*** | (2006.01) |

(52) U.S. Cl. ..... 419/26; 419/38; 419/66

(58) Field of Classification Search ..... 419/38, 419/26, 66

See application file for complete search history.

(56) References Cited

U.S. PATENT DOCUMENTS 2,696,434 A 12/1954 Bartlett (Continued)

FOREIGN PATENT DOCUMENTS

JP 56046164 A2 4/1981

OTHER PUBLICATIONS

The International Search Report and Written Opinion as mailed on Feb. 11, 2008 for International Patent Application PCT/US2007/079198.

(Continued)

*Primary Examiner* — George Wyszomierski
*Assistant Examiner* — Tima M McGuthry Banks
(74) *Attorney, Agent, or Firm* — Quarles & Brady LLP

(57) ABSTRACT

A method is disclosed of forming a powder metal compact. Powder metal is placed in an annular space of a compaction die tool set in which the annular space has inner and outer cylindrical surfaces that form inner and outer cylindrical surfaces of the powder metal compact. An elastomeric tool has a first cylindrical surface adjacent to a fixed cylindrical surface of the compaction die tool set that is radially fixed and further has a second cylindrical surface, opposite to the first cylindrical surface, that touches the powder metal. The powder metal is compressed to form the powder metal compact by applying an external axial force on the elastomeric tool while maintaining the diameter of the fixed cylindrical surface so as to cause the elastomeric tool to compress the second cylindrical surface of the elastomeric tool against the powder metal.

19 Claims, 17 Drawing Sheets

U.S. PATENT DOCUMENTS

| | | | | |
|---|---|---|---|---|
| 3,165,094 | A | | 1/1965 | Lechtenberg |
| 3,897,531 | A | * | 7/1975 | Overhoff et al. ..... 264/109 |
| 4,039,703 | A | | 8/1977 | Kamijo et al. |
| 4,046,499 | A | | 9/1977 | Saito |
| 4,496,299 | A | | 1/1985 | Pettersson |
| 4,564,352 | A | | 1/1986 | Pettersson |
| 4,604,252 | A | | 8/1986 | Stigler |
| 4,650,644 | A | | 3/1987 | Huret et al. |
| 4,822,273 | A | | 4/1989 | Adams et al. |
| 4,880,598 | A | | 11/1989 | Kaad et al. |
| 4,959,276 | A | | 9/1990 | Hagiwara et al. |
| 5,255,433 | A | | 10/1993 | Jin et al. |
| 5,346,529 | A | | 9/1994 | Pettersson |
| 5,466,414 | A | | 11/1995 | Pettersson |
| 5,501,529 | A | | 3/1996 | Cadle et al. |
| 5,631,029 | A | | 5/1997 | Bewlay et al. |
| 5,747,073 | A | | 5/1998 | Pettersson et al. |
| 5,749,331 | A | | 5/1998 | Pettersson et al. |
| 5,815,789 | A | | 9/1998 | Akpan |
| 5,842,109 | A | | 11/1998 | Akpan et al. |

OTHER PUBLICATIONS

Koizumi M., Nishihara M.: "Isostatic Pressing Technology and Applications" 1991, Elsevier Applied Science, England, XP002466161, p. 60-p. 61; pp. 67-68.

* cited by examiner

FIG. 7
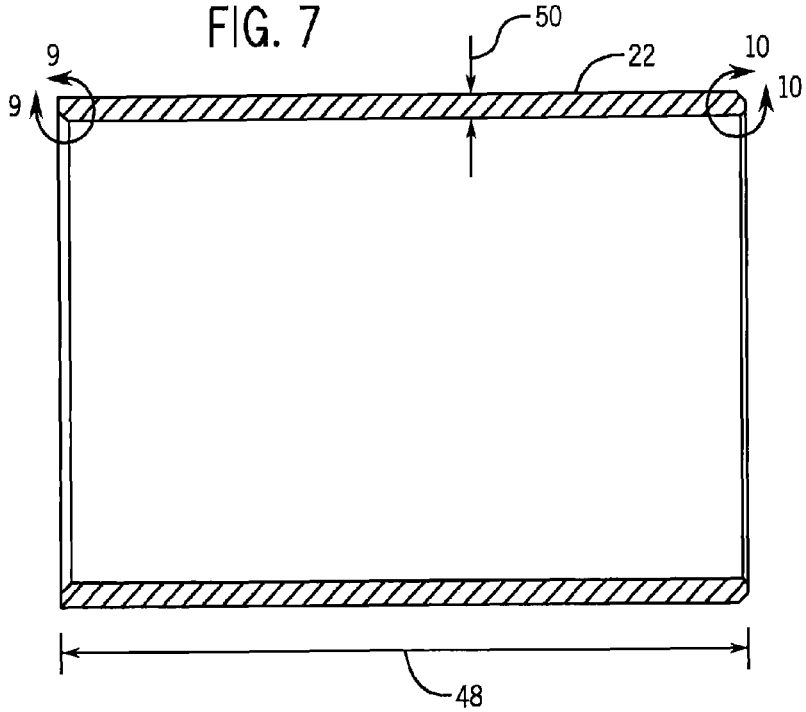
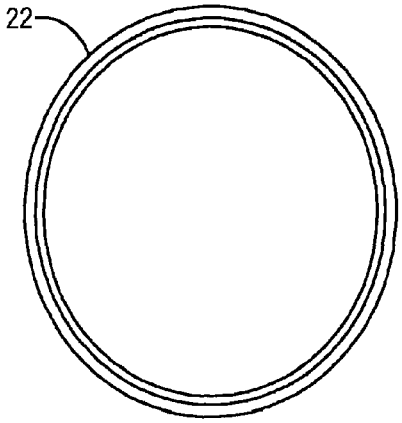
FIG. 8
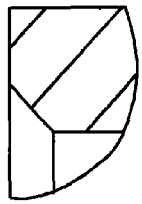
FIG. 9
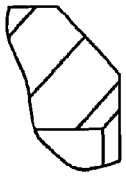
FIG. 10

THIN WALLED POWDER METAL COMPONENT MANUFACTURING

CROSS REFERENCE TO RELATED APPLICATIONS

This application represents the national stage application of International Application PCT/US2007/079198 filed 21 Sep. 2007, which claims the benefit of U.S. Provisional Patent Application No. 60/826,615 filed Sep. 22, 2006 and of U.S. Provisional Patent Application No. 60/957,606 filed Aug. 23, 2007, which are incorporated herein by reference in their entirety for all purposes.

STATEMENT CONCERNING FEDERALLY SPONSORED RESEARCH OR DEVELOPMENT

Not applicable.

FIELD OF THE INVENTION

This invention relates to sintered powder metal manufacturing and in particular to a powder metal apparatus and method which can be used to manufacture components such as cylinder liners, or other devices having a high length to wall thickness ratio, and the powder metal components manufactured therefrom.

BACKGROUND OF THE INVENTION

The use of sintered powder metal (PM) parts has accelerated in the recent past for components difficult to manufacture by other methods as PM components can offer a cost effective alternative to other metal formed components. Some advantages of powder metallurgy include lower costs, improved quality, increased productivity and greater design flexibility. These advantages are achieved in part because PM parts can be manufactured to net-shape or near-net shape which yields little material waste, and which in turn eliminates or minimizes machining. Other advantages of the PM manufacturing process and parts produced therefrom, particularly over other metal forming processes, include greater material flexibility including graded structures or composite metal, lighter weight of the parts, greater mechanical flexibility, reducing energy consumption and material waste in the manufacturing process, high dimensional accuracy of the part, good surface finish of the part, controlled porosity for self-lubrication or infiltration, increased strength and corrosion resistance of the component, and low emissions, among others.

Internal combustion engine manufacturers have sought more efficient, cost effective and viable ways to reduce cost and weight in engines without sacrificing performance and/or safety. One of the largest and most important components of the engine is the cylinder block. In the past, cylinder blocks had been formed from cast iron, which provided strength, durability and long service life. However, as can be appreciated, cast iron is quite heavy. Further, cast iron has a relatively poor thermal conductivity. Consequently, alternatives to cast iron cylinder blocks are sought.

One such alternative is to form the blocks from aluminum. Aluminum is very lightweight and has good thermal conductivity, each of which are desirable features in the engine industry. However, aluminum is relatively soft and easily scratched and thus does not provide the strength, durability and long service life required for use in a cylinder block, particularly with respect to the requirements of the cylinder bores in the block. Further, aluminum has a relatively high coefficient of thermal expansion compared to iron, which can increase blowby between a cylinder and piston during combustion at high operating temperatures, thereby increasing emissions.

As an alternative, engine manufacturers have used more wear resistant cylinder liners within the cylinder bores of an aluminum block. Cylinder liners are typically in-cast into aluminum engine blocks to provide improved wear resistance compared to the aluminum bore that is present without the liner. A cast iron, machined cylinder liner is typically used for engines that require a cylinder liner. However, these cast iron cylinder liners have a less than desirable mechanical bond with the aluminum engine block which leads to less than desirable heat transfer properties. Further, features are required on the outside of the cast iron cylinder liner to "lock" in place in the aluminum block, and these features can create an uneven heat transfer from the cast iron cylinder liner to the aluminum block, or undesirable voids or local hot spots can be created between the liner and the aluminum. Additionally, the alloys used in cast iron cylinder liners are not optimum relative to strength and stiffness, resulting in bore distortion during combustion, more blow-by and higher emissions.

The inherent porosity of a powder metal iron alloy part, when in-cast into an aluminum casting, allows the molten aluminum to infiltrate the matrix of the PM part to improve the bond between the surrounding aluminum and the PM part. Allowing penetration of the molten aluminum into the cylinder liner porosity also takes advantage of the desirable machinability of the impregnated PM matrix. Further, the alloys which can be used for a PM part allow for higher strength and stiffness when compared to a cast iron part.

Although PM technology has the potential of overcoming some of the problems with cast iron cylinder liners, production of PM cylinder liners by conventional axial compaction to net shape or near net shape has not been commercially feasible. One reason is that the high length to wall thickness ratio results in excessive difficulties filling the compaction die with metal powder. In addition, compacting from the ends of a part with a high aspect ratio results in an unacceptable density gradient along the length of the cylinder liner, and inadequate green strength of the compact. These problems can be somewhat overcome using cold isostatic compaction plus subsequent secondary manufacturing operations, but can be too costly in comparison with cast cylinder liners.

While the above discussion has been directed to cylinder liners, other devices having a high length to wall thickness ratio, such as bushings, and electric motor stators or armatures for example, have similar problems when attempting to produce these parts using powder metal technology.

SUMMARY OF THE INVENTION

The present invention provides a manufacturing apparatus and method which can be used to make cylinder liner compacts, or other component compacts having a high length to wall thickness ratio, out of powder metal, for subsequent sintering.

In one aspect, the invention provides a cylinder liner which has a powder metal composition formed into a cylinder, where the cylinder includes a wall thickness and a length, and a ratio of the length to the thickness is relatively high. The invention can also advantageously be applied to other PM components having a high aspect ratio. The higher the ratio, the more applicable is the invention, as the invention enables aspect ratios higher than 24:1, for example 50:1 in cylinder liners with little or no subsequent material removal by machining required of the side walls of the liner.

In another aspect, the invention provides a powder metal component formed with an elastomeric (e.g., rubber or polyurethane) compaction die and an approximately rigid (e.g., steel) core rod such that the wall thickness has a density along its length that provides adequate green strength for subsequent ejection, handling, sintering and subsequent manufacturing processes. Alternatively, the core rod can be elastomeric and the die can be rigid, for example a steel die and a rubber or polyurethane core rod. Preferably, the density is relatively uniform along the length of the part.

In another aspect, the invention provides an internal combustion engine that has an engine block with at least one combustion cylinder liner of the invention.

In another aspect, an ejection punch can be made flush with the liner compact, i.e., of the same inside diameter and outside diameter of the cylinder liner, and a second lower punch used to relieve the pressing of the elastic die against the liner compact prior to ejecting the compact with the ejection punch. This helps to support the end of the compact against end cracking when the pressure on the elastic die is relieved.

In another aspect, the elastic die is compressed without substantial axial compression of the powder metal. A two piece upper punch is used to first seal the powder cavity, and then a second upper punch is used to axially compress the elastic die to radially compress the powder metal in the cavity.

In another aspect, collet sections are provided against the elastic die that compress the die radially when they are cammed against a mating collet, that is force axially onto the collet sections. The compression of the powder is substantially radial, with the powder metal being compressed by the elastic die to form the compact.

An advantage of the present invention is being able to make a low density powder metal cylinder liner (e.g., nominally 6.3 g/cc) improve the bond between the surrounding aluminum and the cylinder liner by allowing penetration of the molten aluminum into the cylinder liner PM matrix porosity.

Another advantage of the present invention is that the resulting improvement in bonding reduces or eliminates the need for outside diameter features, and improves uniformity of heat transfer from the combustion chamber to the surrounding aluminum.

Another advantage is that aluminum impregnated PM is quite machinable, which is an advantage when the engine block with the cylinder liners installed is machined.

Another advantage of the present invention is providing a powder metal component that has acceptable density, and preferably relatively uniform density, along the length of the wall from end to end.

The present invention provides the advantages discussed above relative to sintered powder metal component manufacture, and conversions of other metal devices to sintered powder metal components.

The foregoing and other advantages of the invention appear in the detailed description which follows. In the description, reference is made to the accompanying drawings which illustrate a preferred embodiment of the invention.

BRIEF DESCRIPTION OF THE DRAWINGS

The drawings are not necessarily to scale or dimensionally accurate. Certain dimensions are increased or reduced and the length to wall thickness (aspect) ratio illustrated is less in FIGS. 1-6 than what it would be in practice to better illustrate the invention.

In the drawings:

FIG. 7 is a cross-sectional view of an embodiment of a powder metal component according to the present invention, particularly a powder metal cylinder liner;

FIG. 8 is an end view of the powder metal component of FIG. 7;

FIG. 9 is a cross-sectional view of detail 9-9 of FIG. 7;

FIG. 10 is a cross-sectional view of detail 10-10 of FIG. 7;

DETAILED DESCRIPTION OF THE PREFERRED EMBODIMENT

Figure 1:
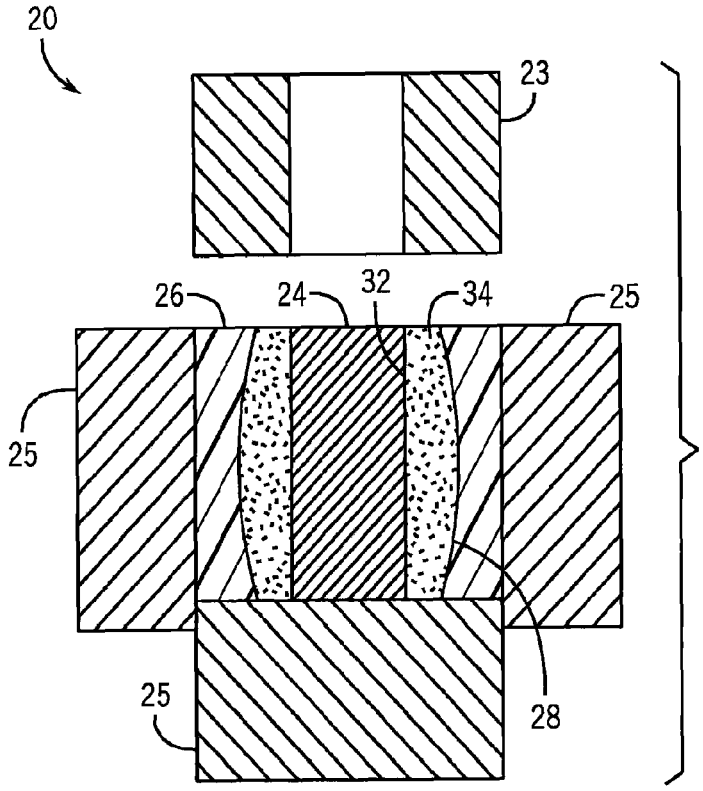
FIG. 1 is a cross-sectional view of an embodiment of an apparatus for the manufacture of a powder metal device according to the present invention, which includes a core rod, and a shaped elastic die configured to circumscribe the core rod, and illustrating the powder metal, die and rod prior to compaction.
Figure 2:
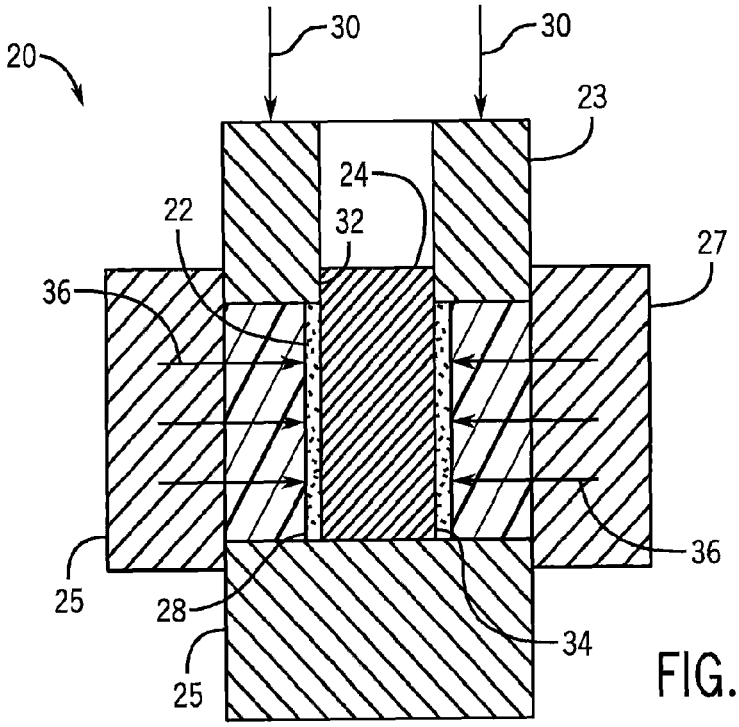
FIG. 2 is a cross-sectional view of the embodiment of FIG. 1, illustrating the powder metal, elastic die and rod during compaction.

Referring now to the drawings, and more particularly to FIGS. 1 and 2, there is shown an apparatus 20 for manufacturing a cylinder liner 22, which includes a core rod 24 made of a hard, incompressible material and a relatively softer and compressible shaped elastomeric die 26 configured to circumscribe core rod 24. Apparatus 20 can include ram or punch 23, support or punch 25, and other elements as are required by a powder metal compaction operation. Alternatively, punch 25 could be provided with a hole like punch 23 to receive rod 24, and both punches 23 and 25 can be moved toward one another simultaneously when compacting the powder metal 34. For simplicity, the force 30 is illustrated as applied to only punch 23 and punch 25 acting as a stationary support.

Shaped elastic die 26 can be made of elastomeric material such as a polyurethane. The polyurethane, or other elastomeric material, can be somewhat firm, for example with a Shore A durometer between 60-95. More specifically, the polyurethane, or other elastomeric material, can have approximately Shore 90 A durometer. Shaped elastic die 26 has an inner contour 28 wherein a longitudinal load 30 on shaped elastic die 26 simultaneously compresses shaped elastic die 26 and deforms inner contour 28, such that the longitudinal center of the elastic die 26 gets thicker faster than its ends, i.e., the walls of the die bulge more in the middle than at the ends. The particular shape, hardness, and compressibility or "bulge factor" required to yield a particular shape of cylinder liner 34 will be empirically determined for each application. The contoured surface of the tool compensates for variations in how the tool expands radially during compression of the tool, to yield a part that is near to the desired shape. In the embodiment of FIGS. 1 and 2, core rod 24 has an outer cylindrical shape 32, and inner contour 28 is longitudinally concave of a certain radius, i.e., inner surface 28 is barrel-shaped. Contour 28 can be other shapes, depending on the exterior shape desired for the liner 22, such as elliptical, hyperbolic, parabolic, some combination thereof, or other complex curvatures or geometries. As used herein, an elastomeric tool, die or core rod means a tool, die or core rod made predominantly of a solid elastomer such that axial compression of the elastomer causes the sides of the tool die or core rod to bulge, and does not include a liquid filled bag or bladder, even if the bag or bladder containing the liquid and the liquid are elastomers. Conceivably however, an elastomeric tool, die or core rod used in the present invention could include hard parts, such as metal or plastic.

Core rod 24 can be a relatively rigid, hard and incompressible metallic rod made of tool steel, or other metals, for example. The core rod 24 provides a hard outer surface 32 that the PM 34 is pressed radially against by the inward bulging of the die 26 simultaneous with the axial compression of the PM directly by the punches 23 and 25.

In a conventional powder metal compaction operation, the die would not have a shaped inner contour, and would also be made of a rigid material, such as tool steel. Further, in a conventional powder metal compaction operation, for a part with a high aspect ratio, there would typically be density variations in the wall of the part along the length, with higher densities at the ends than at the middle of the part.

In contrast, ram 23 of apparatus 20 simultaneously compresses shaped elastic die 26 and powder metal composition 34, as shown in FIG. 2. The force of inner contour 28 on PM composition 34 tends to act normal to the surface of inner contour 28, not considering shear forces. As can be seen in FIG. 1, there tends to be an initial downward but generally radially directed force at the upper end and an initial upward force but generally radially directed force at the lower end of elastic die 26, which forces act on powder metal composition 34 to counteract the tendency of over densification of the ends of powder metal compact 22, which density variation would occur with conventional powder metal techniques that only compress axially (longitudinally).

As ram 23 simultaneously compresses shaped elastic die 26 and powder metal composition 34, shaped elastic die 26 deforms by bulging inward to apply radial forces 36 to composition 34 to help create and maintain a more uniform density along the length of green powder metal compact 22 from end to end.

Figure 3:
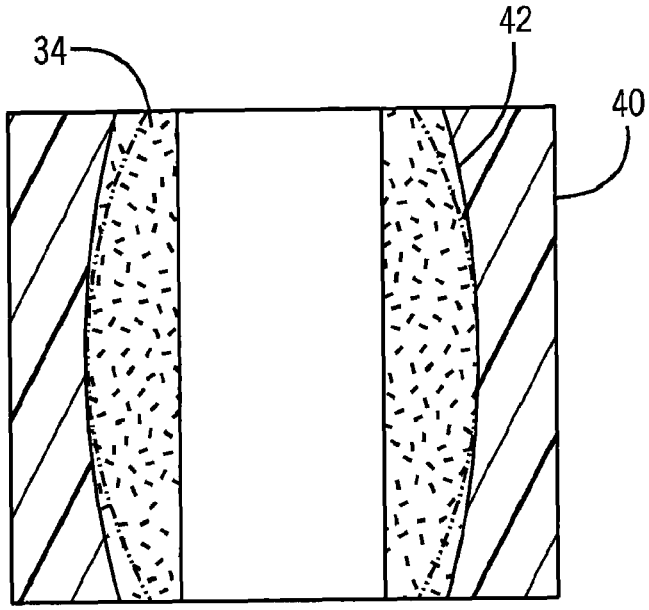
FIG. 3 is a cross-sectional view of another embodiment of the die of FIG. 1, which has a longer radius on the inner contour than the die of FIGS. 1 and 2.
Figure 4:
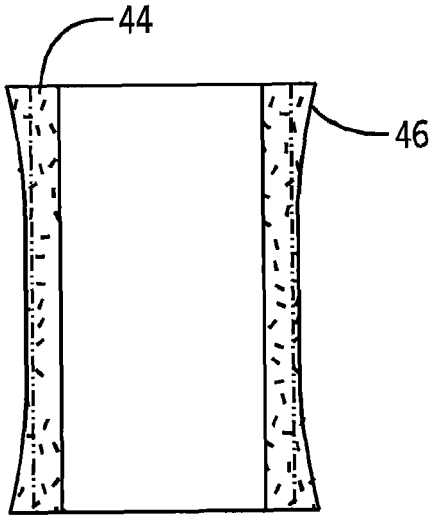
FIG. 4 is a cross-sectional view of a powder metal component manufactured using the die of FIG. 3.

In FIGS. 3 and 4, shaped elastic die 40 is depicted, which can be used in place of shaped elastic die 26 in apparatus 20. The curvature of die 40 is less than that of die 26, or in other words contour 42 is of a longer radius than contour 28, so the barrel-shape is less bulging or pronounced. The resulting powder metal compact 44, which can be prepared using apparatus 20 with shaped elastic die 40 in place of shaped elastic die 26, can include an outer contour 46 which has an hourglass type cross-section. This can be advantageous in the manufacture of powder metal cylinder liners because the hourglass shape can help constrain the cylinder liner in place when being in-cast with an aluminum engine block. The shaped elastic die can be configured in a multitude of different shapes as required by the net shape of the particular powder metal component being produced. The phantom lines in FIGS. 3 and 4 are the comparative inner contour 28 of shaped elastic die 26, and outer contour of cylinder liner 22, respectively.

Powder metal composition 34 can include approximately between 85% and 99% sponge iron powder, approximately between 0.1% and 2.0% graphite, and approximately between 0.1% and 2.0% a synthetic wax such as ethylene bis-stearamide wax (synonymous with N, N' ethylene bis-stearamide; N, N' distearoylethyelendiamine; EBS). More specifically, powder metal composition 34 can include approximately 98.1% sponge iron powder, approximately 0.9% graphite, and approximately 1.0% ethylene bis-stearamide wax. Sponge iron powder results from the direct reduction of high grade magnetite iron ore. This process results in spongy particles (as viewed in photomicrographs, for example) which have good compressibility, exceptionally good green strength and produces parts with good edge integrity. Ancor MH-100 is an example of such a sponge iron powder.

The synthetic wax powder is used as a lubricant and binder for the compaction of powdered metal parts, such as Acrawax® lubricant. The graphite is a high quality powder graphite for sintering and alloy control, such as Asbury 3203 graphite. Powder metal composition 34 can additionally include up to 0.5% phosphorus.

Powder metal cylinder liner 22 consequently has a relatively uniform density along length 48 of the cylinder. FIG. 7 shows the sintered and machined cylinder liner. The density can be approximately between 5.8 g/cm$^3$ and 6.8 g/cm$^3$, and more specifically, the density is approximately 6.3 g/cm$^3$. Thickness 50 can be less than approximately 0.20 inches after machining. Prior to machining the inside diameter, the wall thickness 50 may be, for example, 0.375 inches, and the machining operation may remove 0.020 from the wall thickness for a total increase in the inside diameter of 0.040. The cylinder liner 22 green compact, as it comes out of one of the dies of FIGS. 1-6, can have a ratio of length 48 to thickness 50 greater than 10, particularly greater than 15, or even greater than 24. For example, the cylinder liner 22 green compact with a length 48 of approximately 5.5 inches and a thickness 50 of approximately 0.375 inches results in an aspect ratio of approximately 14.7. With this liner, perhaps 0.200 would be machined off to produce a final wall thickness of 0.175. However, it is contemplated that the invention could be applied to produce a cylinder liner with an aspect ratio greater than 24:1, and equal to or maybe even greater than 50:1. At an aspect ratio of 50:1, the cylinder liner could be compacted and sintered to its finished wall thickness, with little or no subsequent material removal by machining (prior to casting it into the cylinder) required to reach a final wall thickness of 0.11. Even an aspect ratio of 24:1 yields a wall thickness of 0.23, which yields a substantial reduction in machining.

The green compact powder metal cylinder liner 22 typically requires sintering at an elevated temperature to strengthen it, as is well known, and some machining to create the features shown in FIGS. 8-10. It's possible however that the sintered part could be made so near net shape that the machining step prior to in-casting could be eliminated, with the only machining being done after the sintered PM liner 22 is cast into the engine block.

Figure 11:
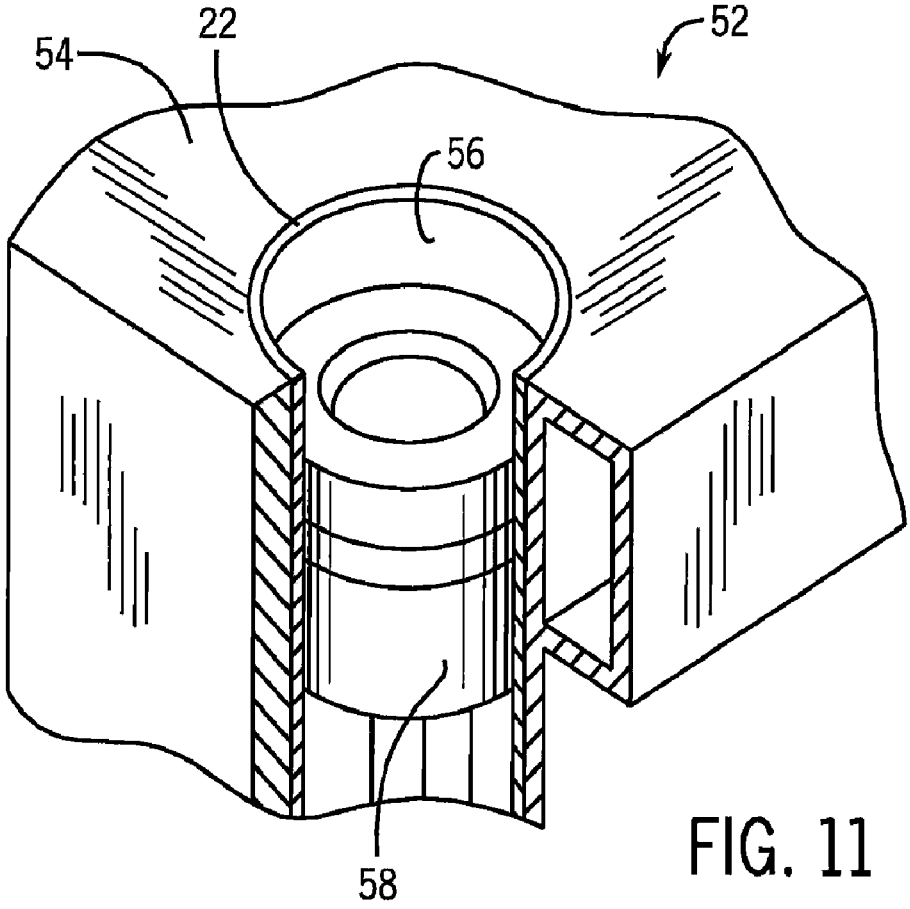
FIG. 11 is a perspective, fragmentary view of an embodiment of an internal combustion engine according to the present invention.

FIG. 11 illustrates an internal combustion engine 52 according to the present invention which includes an engine block 54 with at least one combustion cylinder bore 56 having therein piston 58, and at least one cylinder liner 22. Internal combustion engine 52 can include other elements such as a fuel system, crankshaft, lubrication system, cooling system and other elements as are known. As stated, the cylinder bore defined by cylinder liner 22, the aluminum that impregnates it and the surrounding aluminum of the block may require additional machining after the liner is cast into the engine block 54. The aluminum impregnated PM matrix of the liner provides a material with good machinability for those processes.

Figure 5:
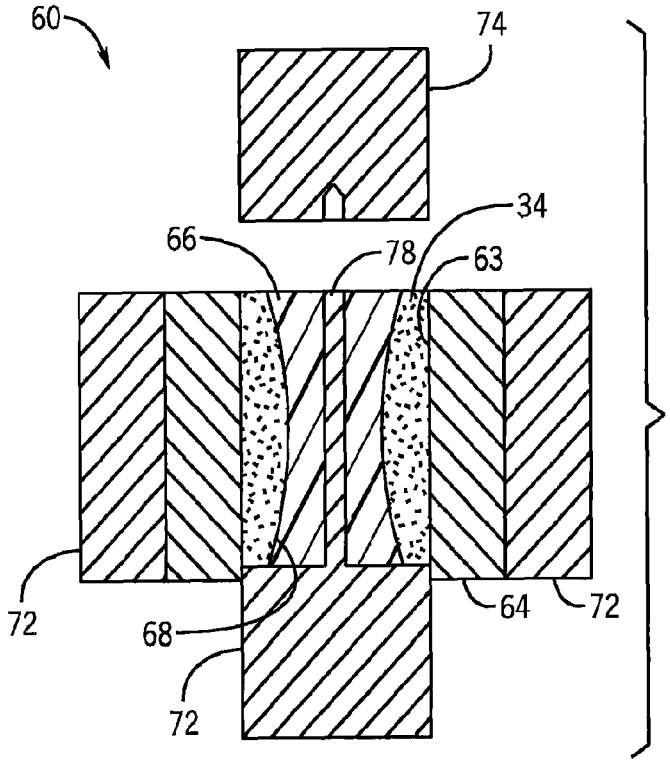
FIG. 5 is a cross-sectional view of an embodiment of an apparatus for the manufacture of a powder metal device according to the present invention, which includes a die and a shaped elastic core rod configured to fit within the die, and illustrating the powder metal, die and rod prior to compaction.
Figure 6:
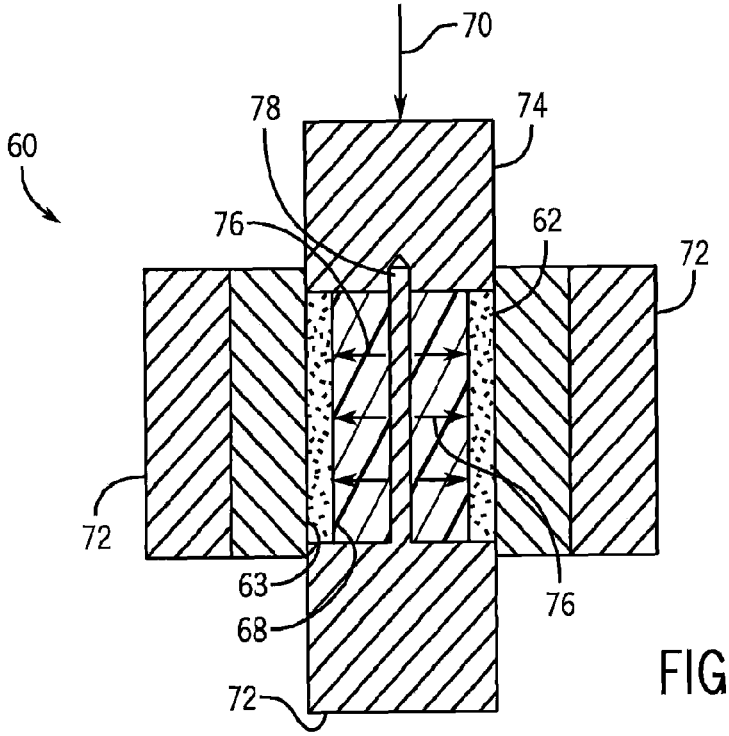
FIG. 6 is a cross-sectional view of the embodiment of FIG. 5, illustrating the powder metal, die and elastic rod during compaction.

In the embodiment of FIGS. 5 and 6, there is disclosed an apparatus 60 for manufacturing a cylinder liner or other powder metal component 62, which includes a die 64 and a shaped elastic core rod 66 configured to fit within die 64. The elastic core rod 66 has an outer surface 68 shaped like an apple core or reverse barrel, flaring outwardly at the ends and tapering toward the middle. A longitudinal load 70 placed on shaped elastic core rod 66 causes surface 68 to bulge outwardly into a generally cylindrical shape as illustrated in FIG. 6, to exert radial forces on PM 34 in the space between rod 66 and die 63.

Shaped elastic core rod 66 can be made of the same, or similar, material as has been described for shaped elastic die 26, and having the same, or similar, characteristics. Further, powder metal component 62 can be made of the same, or similar, powder metal composition as has been described for cylinder liner 22, and having the same, or similar, characteristics.

Apparatus 60 includes press elements 72 and ram 74, wherein apparatus 60 compresses elastomeric core rod 66 and powder metal composition 34 in the longitudinal direction; and deforms elastomeric core rod 66 in radial direction 76 to compress it against the relatively harder surface 63 simultaneous with the axial pressure exerted directly on the PM 34 by punches 72 and 74. Apparatus 60 additionally includes pin 78 to help keep elastomeric core rod 66 straight and centered during compaction.

As has been previously described for shaped elastic die 26, elastomeric core rod 66, and particularly outer contour 68, can have a variety of geometries as dictated by the required shape of the powder metal component being manufactured.

The finish of the surface of the liner 22, 44 or 62 is affected by the material of the surface that is used to compress it. Hard surfaces, such as the surface 32 of the steel core rod 24 and the inner surface 63 of the steel die 64 produce a surface with a more polished or glossy finish, and the relatively softer surfaces 28 and 68 of the respective rubber die 26 or core rod 66 produce a surface with more of a matte finish. The matte finish is preferred for the outer surface of the liner, as it presents a surface that is more penetrable by the molten aluminum of the engine block and the polished surface is less penetrable by it. The polished surface is preferred for the bore surface for wear resistance (if not machined) and because it is less penetrable by molten aluminum. These finishes are produced by using the elastomeric die and hard core rod embodiments of FIGS. 1-4, and therefore is presently preferred if finish type is deemed important. However, interests in manufacturability may favor the embodiment of FIGS. 5-6 because with that embodiment the area that the elastomer rubs (the outside of pin 78) on relaxation of the die is less than the area (the inside surface of steel die 27) in FIGS. 1-4, which may adversely affect the life of the elastomer parts of the tool set.

The matte finish is produced by an elastomeric die with a smooth surface. In addition, the surface of the die can be textured, with ribs, grooves, bumps, or other textures which will produce the inverse of the texture in the finished part, and these textures in the outside diameter surface of the liner can be beneficial to help lock the liner in the cylinder when it is cast into the cylinder and the molten aluminum fills the small crevasses creating by the textures. The textures must be low enough in height so that when the pressure on the die is relieved, the textures pull away from the compact far enough so the compact can be ejected without interference with the textures.

While a uniform density distribution throughout the length of the part being compacted would typically be the goal, the invention could permit customizing the shape of the elastomeric tool of the tool set to provide any desired density distribution throughout the length of the part being compacted. By shaping the elastomeric tool appropriately or making it out of elastomeric materials of different compressibilities to vary how much the material bulges for a given axial load, more or less radial force can be exerted, thereby increasing or decreasing the density locally along the surface of the elastomeric tool. For example, the material of the elastomeric tool in the middle of the tool could be made softer and more compressible than the material at the ends, to make the middle of the PM part of higher density than the ends. Combining using materials of different compressibilities with different shapes of the tool allows engineering the shape and the density distribution of the PM component. In addition, it may be possible to create an elastomeric compressing tool of a material of a uniform compressibility but that reacts differently locally by creating voids, such as holes, grooves or slots, in the elastomer material, to make it change shape differently or push with more or less force on the PM in a local area than if the elastomer tool was solid with no voids all of the way through. The voids could also be filled with a material of a different compressibility or bulge factor. Also, since the elastomer tool will pull radially away from the PM part when pressure is relieved from the tool set, it is possible to form undercuts in PM parts using the invention, as indicated in FIG. 4 with the liner 44 having mushroomed or flared ends on its outer surface.

One of the difficulties that can occur in using an elastomeric tool is that it stores energy and can be damaged as it flows around corners in the die during the compaction process. When pressure is relieved on the elastomeric tool at the end of a compaction of a cylinder liner, in preparation to eject the green compact cylinder liner, the elastomeric tool may expand axially faster than it pulls away from the green compact radially, resulting in cracking of the ends of the compact.

FIGS. 12A-D illustrate a solution to the cracking ends problem, shown applied to embodiment, like FIG. 1 of the present invention, in which the elastomeric component in the die set is an elastomeric die 126. In this embodiment, for corresponding elements the same reference numbers are used as in FIG. 1, plus 100. The elastomeric die 126 is not shown as having any curved cross-sectional shapes, but it could be so shaped.

Figure 12A:
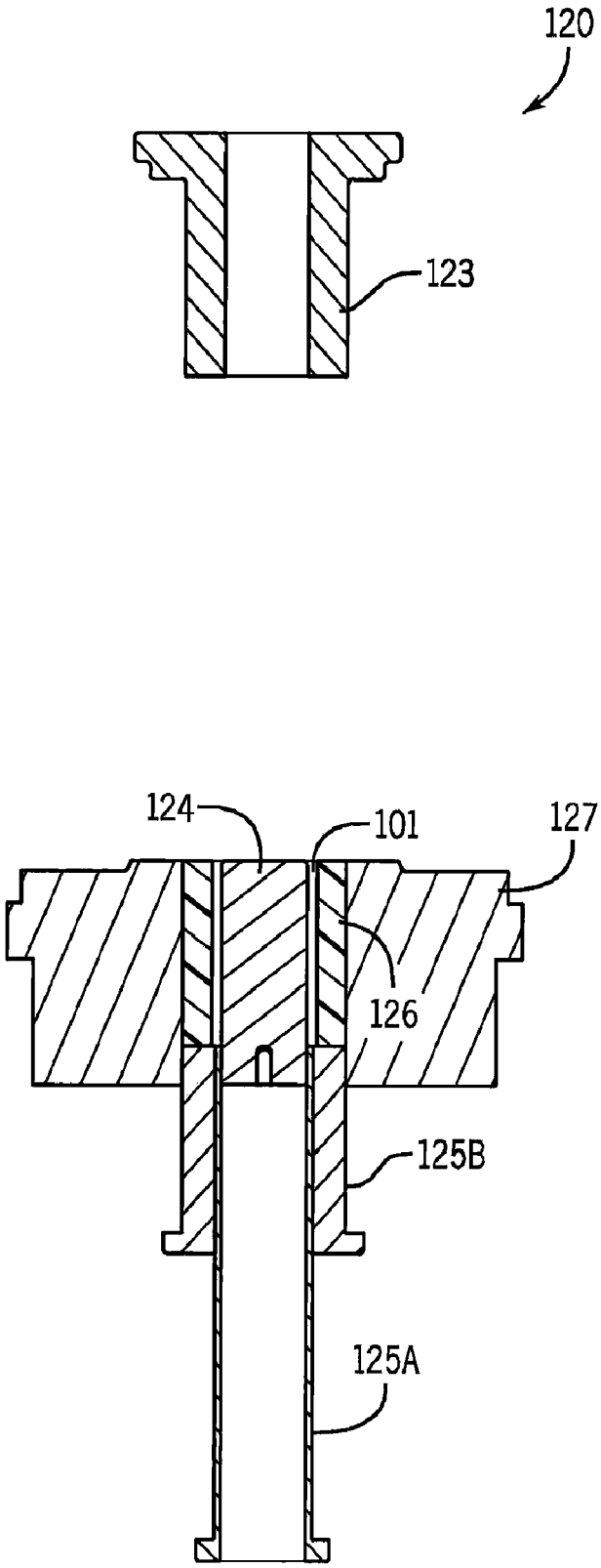
FIG. 12A is a cross-sectional view of an alternate compaction die set in a fill position.

FIG. 12A illustrates the fill position of the die set, in which powder metal is filled into the annular space 101 between the inside diameter of the elastomeric die 126 and the outside of the hard tool steel core rod 124. All of the punches, core rod and powder are received in die 127. The bottom punch 125 is in two pieces 125A and 125B. The inner punch 125A has the same inside and outside diameters as the compacted cylinder liner compact 122 at the bottom of the compact 122. These are preferably the preferred nominal dimensions of the compact. The outer punch 125B extends in thickness from the outside of punch 125A to the inside diameter of the bore in the die 127 in which the die set resides. The powder fill void 101 spans all of the inner punch 125A and part of the outer punch 125B.

Figure 12B:
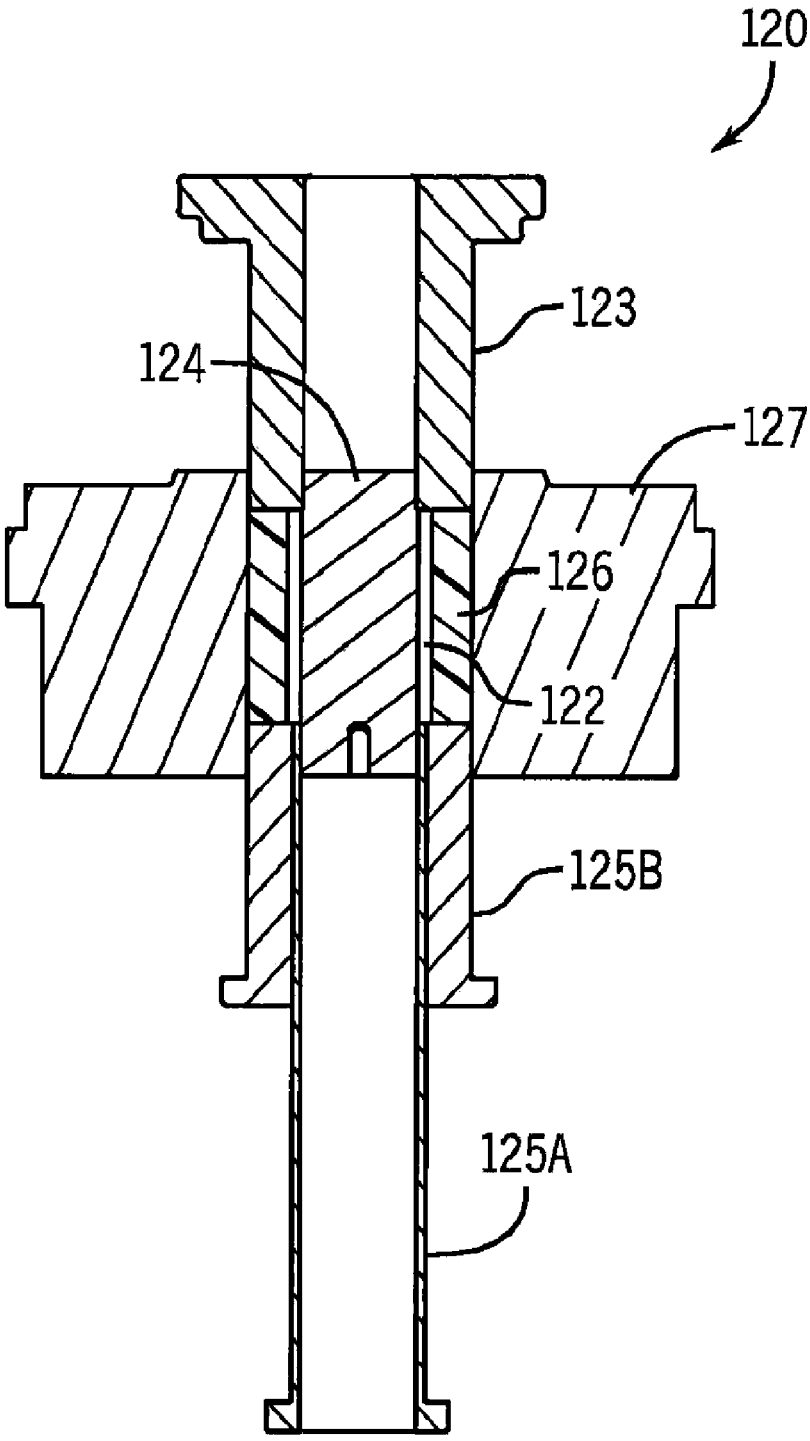
FIG. 12B is a cross-sectional view of the compaction die set of FIG. 12A in a compact position.

During the compaction process as shown in FIG. 12B, The upper punch 123 moves down to compress the powder 122 and the elastomeric component 126. The two lower punches 125A and 125B can also move up together and/or the die 127 can float to equalize the compaction forces of the upper and lower punches. When the compaction is complete as shown in FIGS. 12B-D, the compacted powder is no longer over the lower outer punch 125B.

Figure 12C:
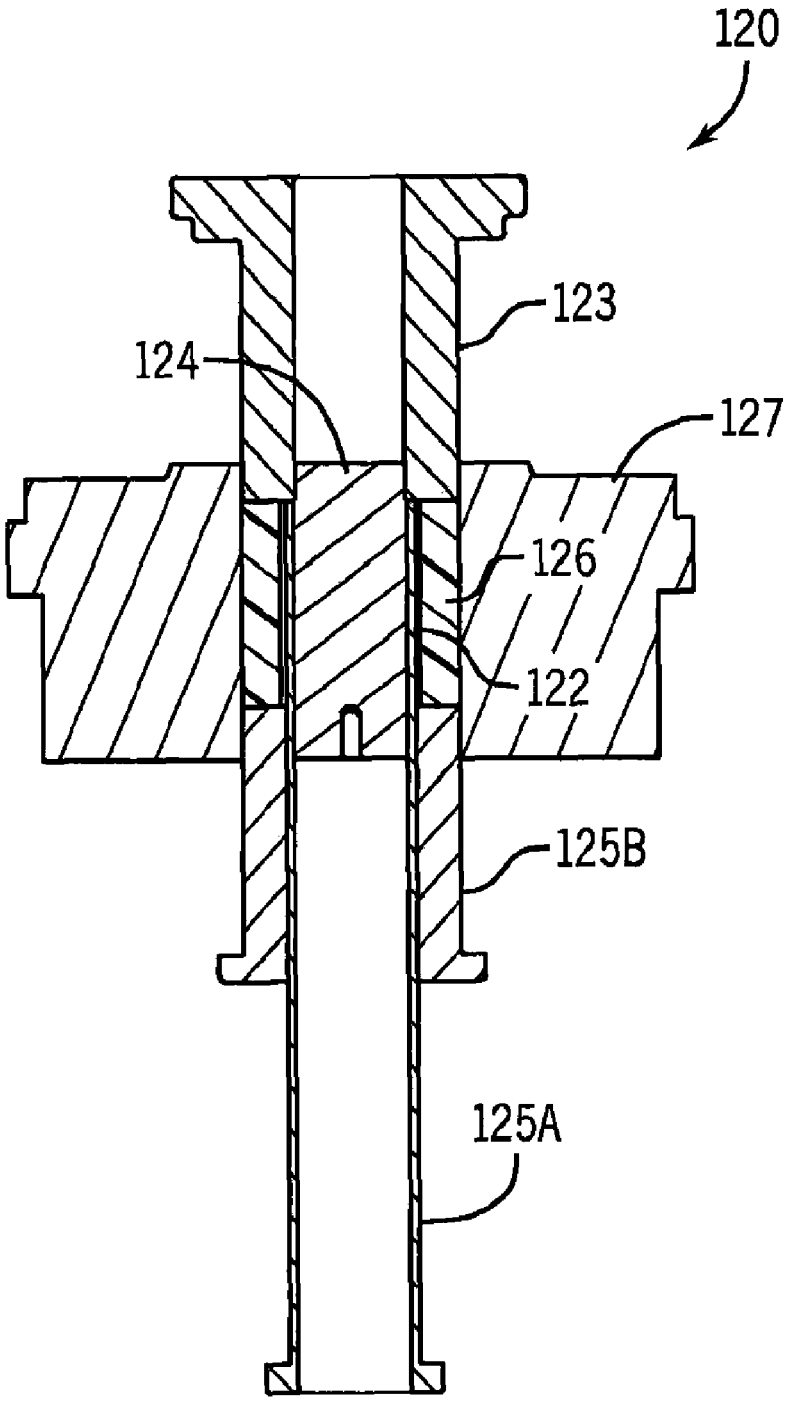
FIG. 12C is a cross-sectional view of the compaction die set of FIG. 12A in a initial eject or relieved position.

Next while the upper punch 123 is held in place the lower outer punch 125B is lowered as illustrated in FIG. 12C to release the energy in the rubber die component 126. If there is a small amount of powder material over the lower outer punch 125B it will be sheared off as the lower outer punch 125B is lowered.

Figure 12D:
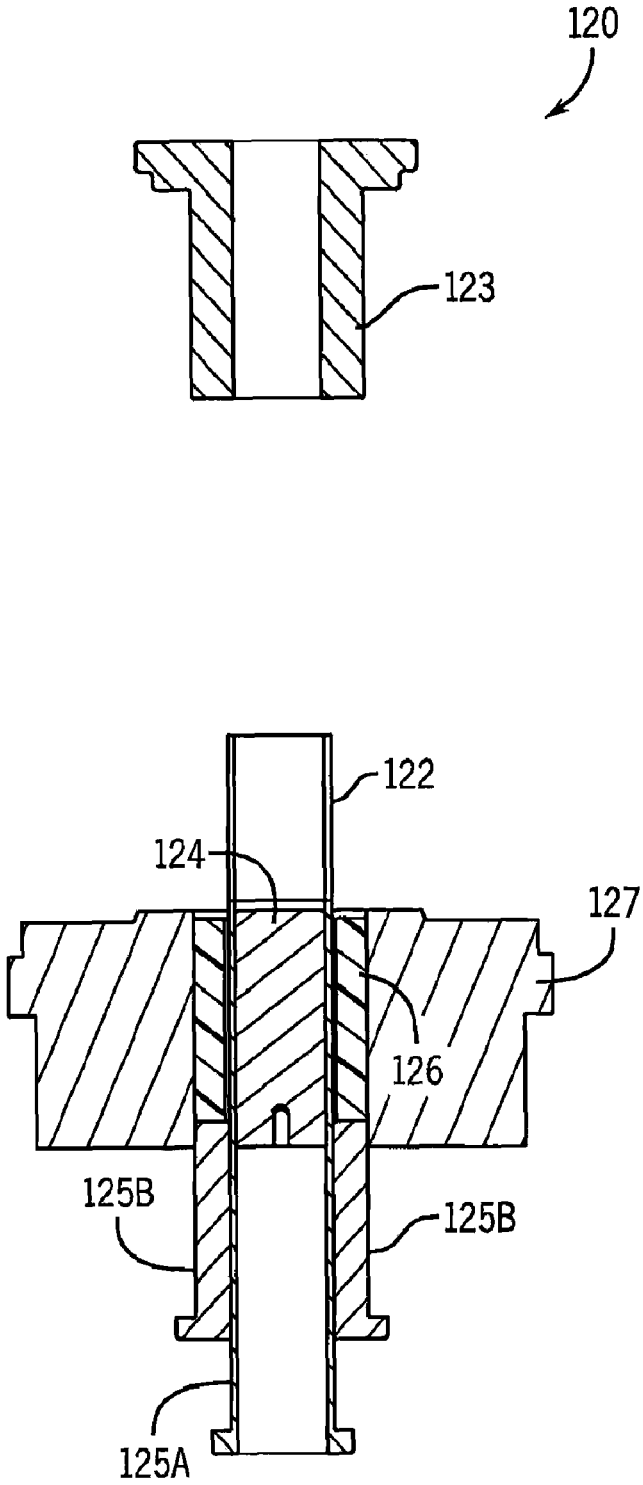
FIG. 12D is a cross-sectional view of the compaction die set of FIG. 12A in an eject position.

Lastly, as illustrated in FIG. 12D, the upper punch 123 moves up and the lower inner punch 125A ejects the compacted sleeve 122. The lower outer punch 125B can eject the rubber die component 126 at this point.

Alternatively, the upper punch 123 could be made in two pieces like the lower punch, with the inner punch of the size of the compacted sleeve 122, and after compaction, pressure on the elastomeric die component 126 relieved from both ends simultaneously. Alternatively, only the top punch could be two piece and pressure relieved from that end only after compaction.

This idea is shown with the elastomeric die component on the OD of the compact but the idea could also be applied to a die set with the elastomeric die component on the ID of the compact.

In another embodiment, illustrated in FIGS. 13A-D, an arrangement that may appear similar to FIGS. 12A-D is illustrated, but with changes. In this embodiment, corresponding elements to the embodiment of FIG. 1 are labeled with the same reference numbers plus 200.

In the embodiment of FIGS. 13A-D, both of the upper 223 and lower 225 punches are two piece, none of the punches is the same size as the compacted sleeve 222 (although one or both of the punches 223A, 225A that contact the ends of the sleeve compact could be) and a different way to obtain even compaction without end cracking is employed. In this embodiment, only the elastomeric component, not the powder, is compacted axially to a significant extent.

Figure 13A:
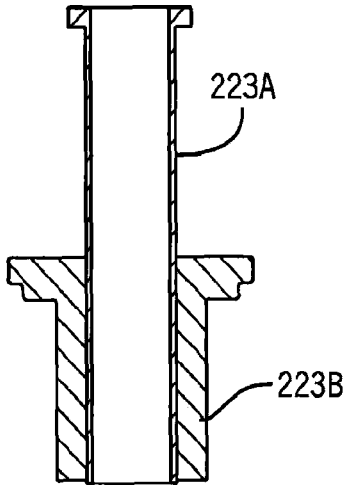
FIG. 13A is a cross-sectional view of another alternate compaction die set in a fill position.
Figure 13A:
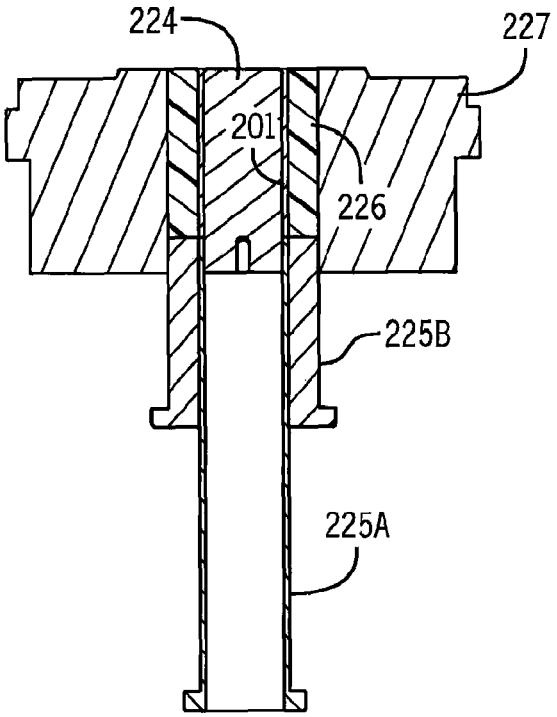
Figure 13B:
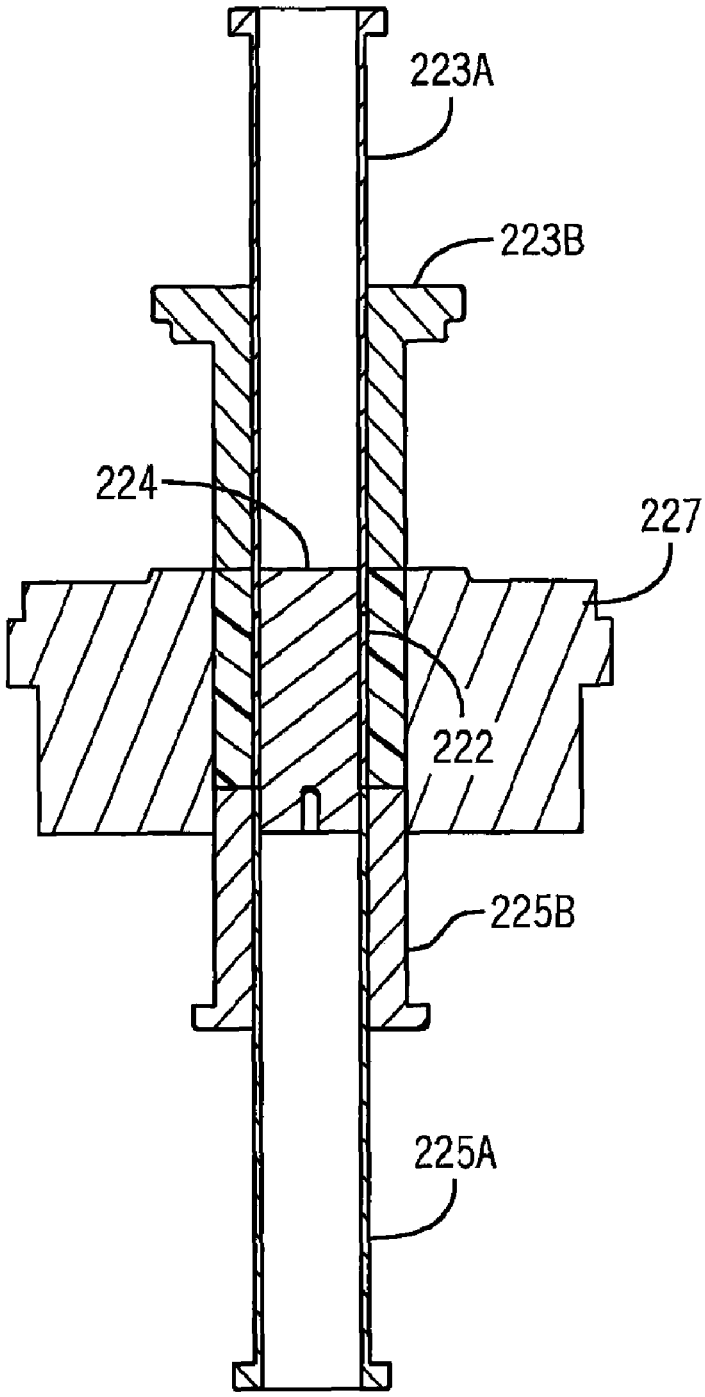
FIG. 13B is a cross-sectional view of the compaction die set of FIG. 13A in a seal position.
Figure 13C:
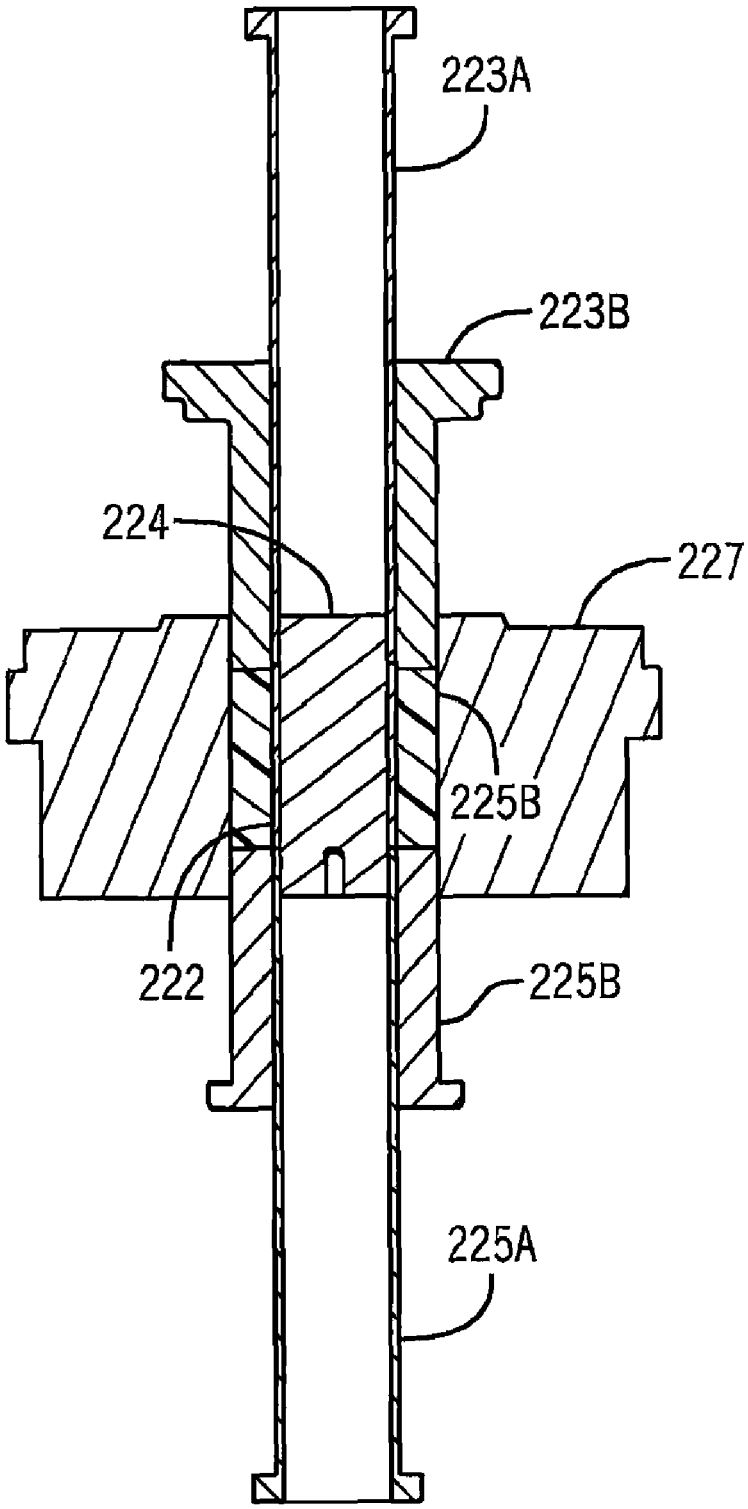
FIG. 13C is a cross-sectional view of the compaction die set of FIG. 13A in a compact position.

Referring to FIG. 13A, powder metal is filled into the annular space 201 between core rod 224 and elastomeric die 226. As illustrated in FIG. 13B, upper punch 223 is then lowered and outer punch 223B is stopped at the top of elastomeric die 226 with only slight pressure exerted. Inner punch 223A is moved into the top of void 201 to seal the top, down to the height of the compacted sleeve 222, with no or only little pressure applied to the powder in the void 201 by the punch 223A. Referring to FIG. 13C, pressure is then applied to the elastomeric die 226 by moving the outer punch 223B further down, while the inner punch 223A is kept stopped. This results in the compression of the powder in the void 201 being almost totally radial in direction, and the punch 223 residing at the top of the elastomeric component 226 during compaction to help offset any bulging of the top of the elastomeric component.

The lower punch 225A could be partially inserted into the bottom of the elastomeric component 226, like the punch 223A is inserted into the top, to create a seal and resist bulging at the ends of the sleeve compact 222. Although the component 226 is not illustrated as being shaped with any curves or surface features, it could be.

Figure 13D:
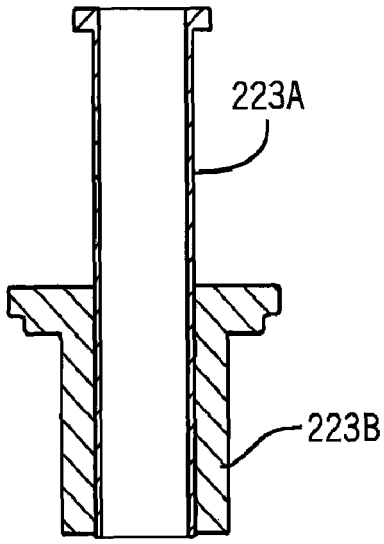
FIG. 13D is a cross-sectional view of the compaction die set of FIG. 13A in an eject position.
Figure 13D:
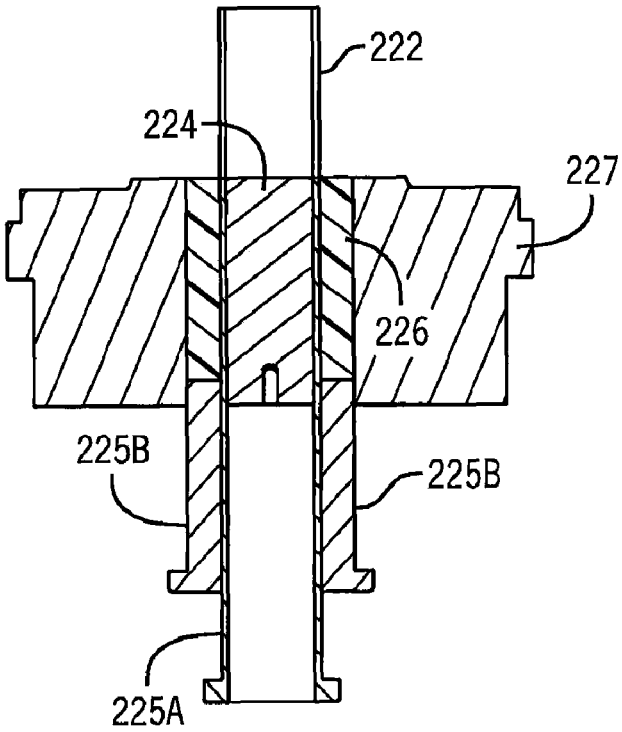

After compaction, the outer punches 223B and 225B are moved apart, either one or both of them, to relieve the pressure on the elastomeric die 226 and cause it to pull away from the sides of the compact 222. The top inner punch 223A (and the outer punch 223B if not already withdrawn) is then withdrawn and bottom inner punch 225A is extended upwardly to eject the sleeve compact 222, as illustrated in FIG. 13D.

Another way to compress the compact radially with little or minimal axial compaction is to use a collet, as illustrated in FIGS. 14A-D. In this embodiment, corresponding elements to the embodiment of FIG. 1 are labeled with the same reference numbers plus 300.

In the embodiment 320 of FIGS. 14A-D, powder metal is placed in the void 301, between elastomeric die 326 and core rod 324, and outside of die 326, collet sections 331 supported by lower punch 325B have wedge shaped frusto-conical surfaces 333 of an angle that mates with frusto-conical surface 337 of collet 329. The collet sections 331 have small spaces between them so that when collet 329 is forced down axially by the press over the sections 333, the sections 331 are cammed radially inward to squeeze the die 326 radially and thereby compact the sleeve 322 radially against the core rod 324. The connection of the sections 331 to the punch 325B permits the sections 331 to move radially inward under force of the collet 329, and restrains them from falling out of position when the collet 329 is withdrawn from them.

Figure 14A:
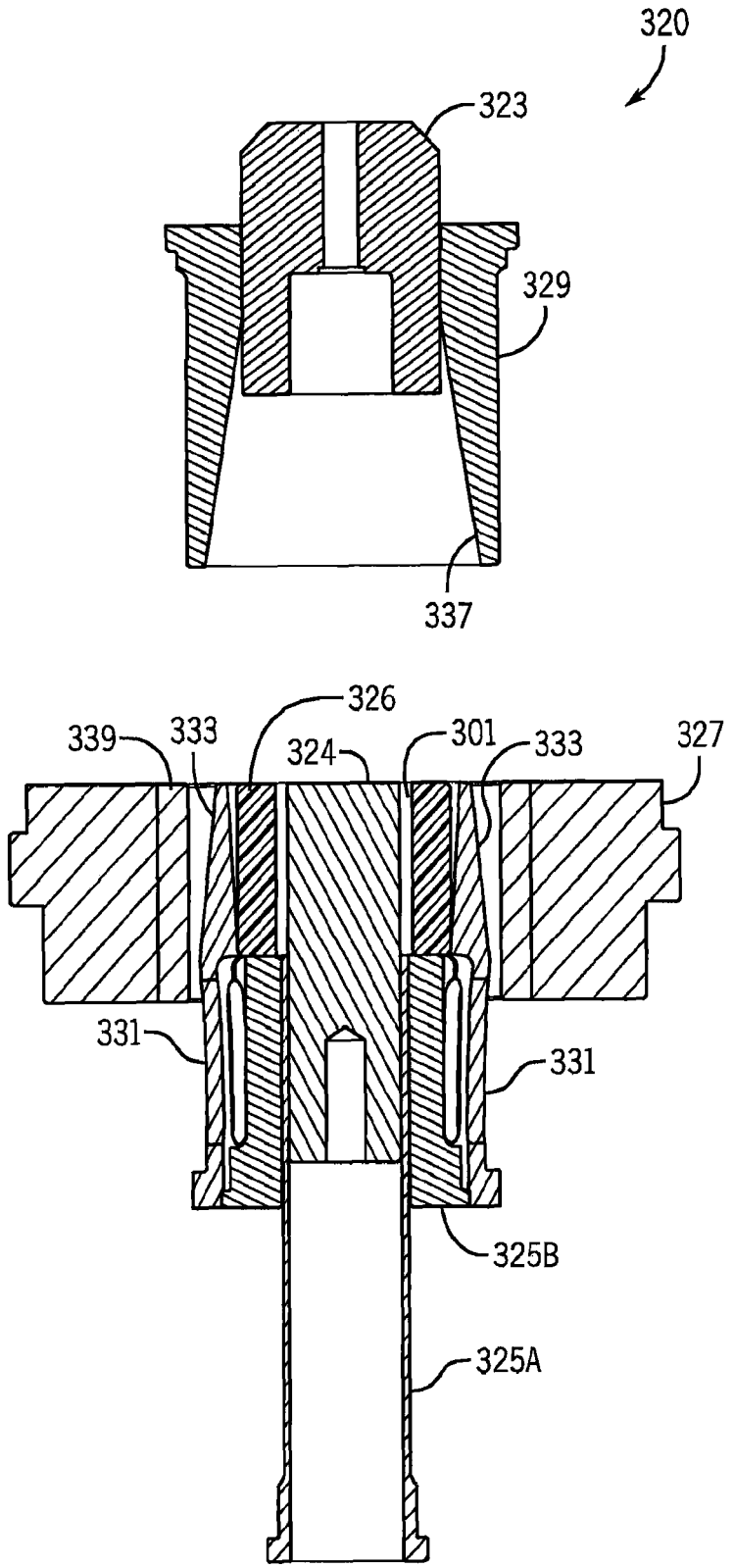
FIG. 14A is a cross-sectional view of an alternate compaction die set in a fill position.
Figure 14B:
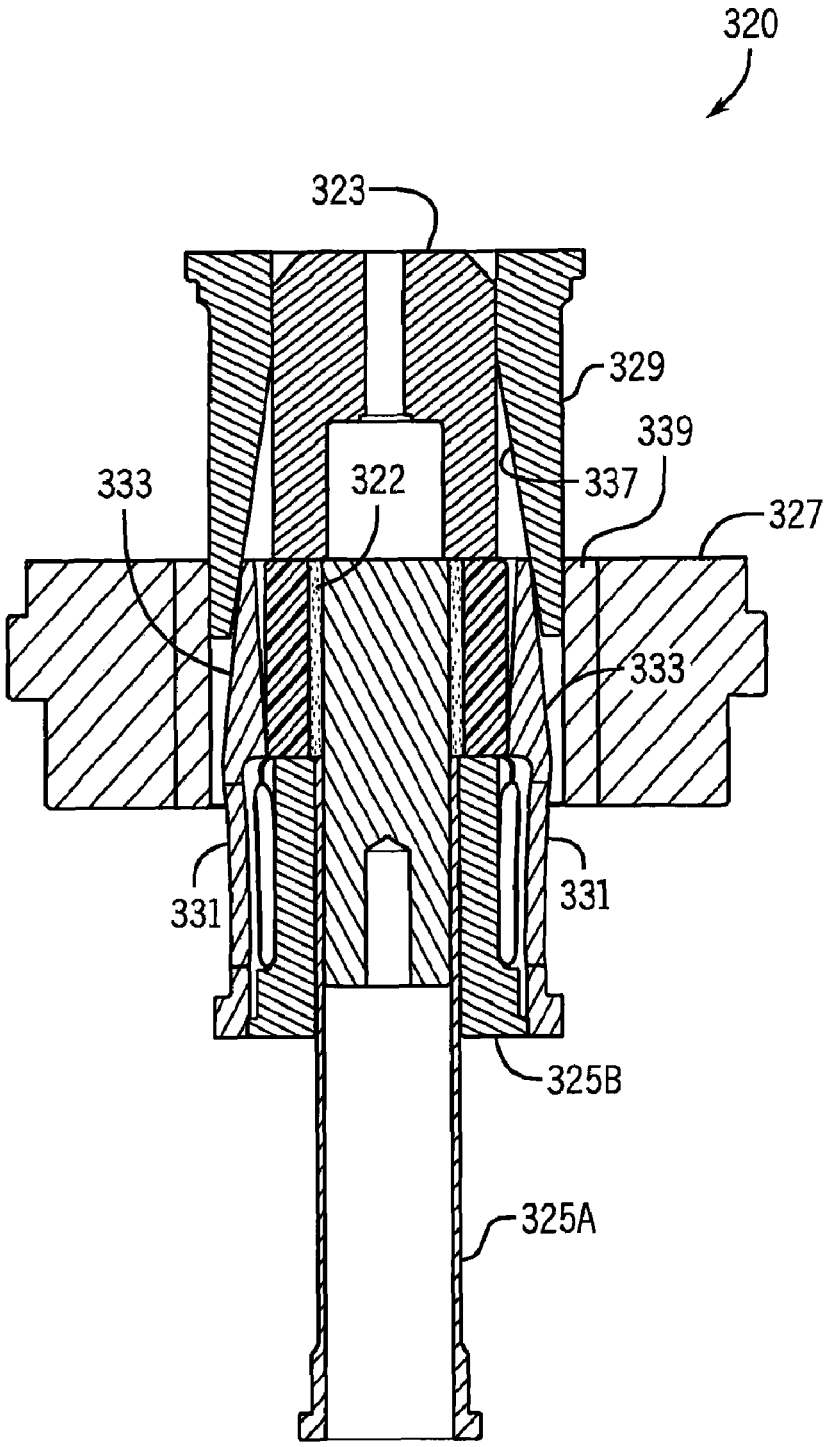
FIG. 14B is a cross-sectional view of the compaction die set of FIG. 14A in a seal position.
Figure 14C:
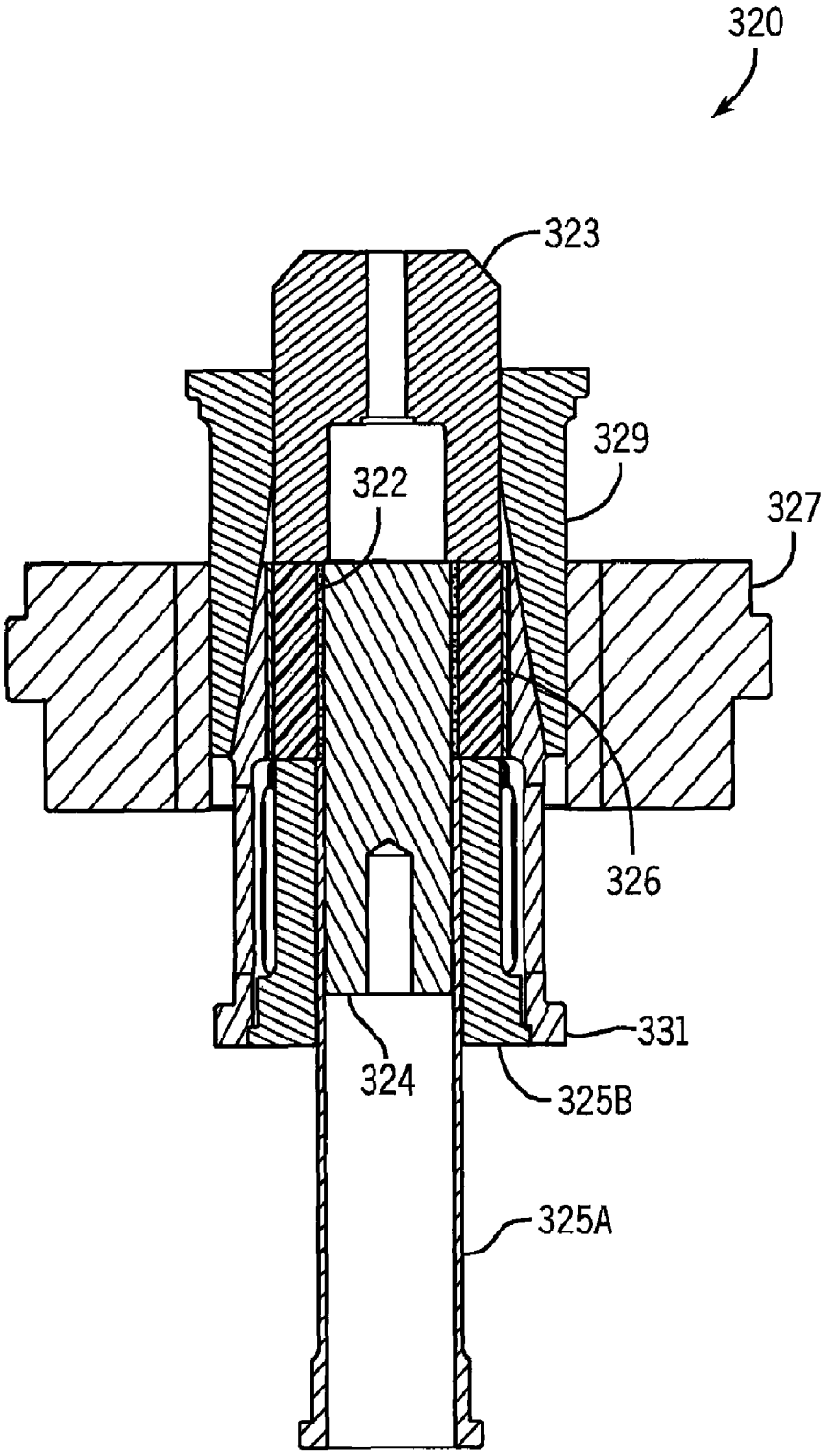
FIG. 14C is a cross-sectional view of the compaction die set of FIG. 14A in a compact position.
Figure 14D:
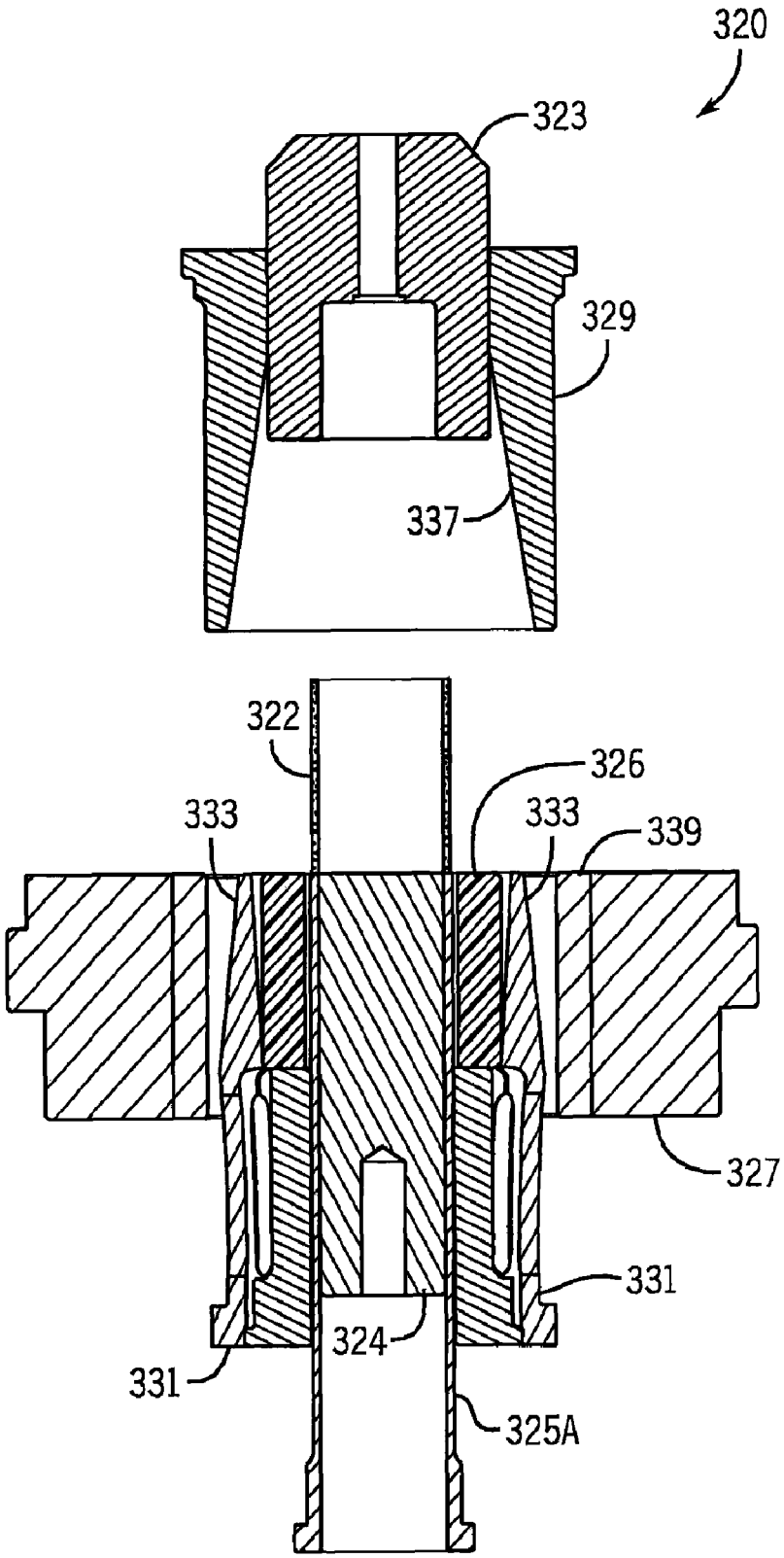
FIG. 14D is a cross-sectional view of the compaction die set of FIG. 14A in an eject position.

FIG. 14A illustrates the fill position in which powder metal for making sleeve 322 in filled into the void 301. FIG. 14B illustrates a seal position, in which the upper punch 323 has been moved down to cover the void 301 and seal it. The upper punch 323 may press against the top of the core rod 324 and the elastomer die 326 somewhat to seal the compression chamber 301. As illustrated in FIG. 14C, further movement of the collet 329 downward (under force of the press) into the space between the collet sections 331 and the sleeve 339 cams the sections 331 radially inwardly, which compresses the elastomer die 326 to compact the powder metal 322 between the die 326 and the core rod 324.

The die 326 as illustrated is not shaped as are the dies of FIGS. 1 and 5, although it could be. Also the invention could be applied to a collet that contracts radially during compaction as illustrated, compressing against an exterior cylindrical surface of the elastomer component 326, or could be applied to a collet that expands radially during compaction by reversing the parts. Also, the lower punch 325A an FIGS. 14A-D is not the same inside diameter and outside diameter as the compacted sleeve 222, although it could be.

In all of the embodiments described above, the elastomeric die component, or tool, is made of a solid elastomeric material. This means that the elastomeric tool can have voids, undercuts or holes, but it is not hollow or filled with anything, such as with a fluid. For example, a bladder filled with a hydraulic fluid would not be considered a solid elastomeric tool or die component, even if the skin of the bladder is made of an elastomer.

A preferred embodiment of the invention has been described in considerable detail. Many modifications and variations to the preferred embodiment described will be apparent to a person of ordinary skill in the art. Therefore, the invention is not limited to the embodiments described.

We claim:

1. A method of forming a powder metal compact having inner and outer cylindrical surfaces about an axis, comprising:

placing the powder metal of the powder metal compact in an annular space of a compaction die tool set, the annular space having inner and outer cylindrical surfaces that form the inner and outer cylindrical surfaces of the powder metal compact, at least one of the inner and outer cylindrical surfaces of the space being defined at least in part by a compressible solid elastomeric tool of the compaction die tool set, the elastomeric tool having a first cylindrical surface adjacent to a fixed cylindrical surface of the compaction die tool set that is radially fixed and the elastomeric tool having a second cylindrical surface opposite to the first cylindrical surface, the second cylindrical surface touching the powder metal; and compressing the powder metal to form the powder metal compact in the space by applying an external axial force on the elastomeric tool while maintaining the diameter of the fixed cylindrical surface so as to cause the elastomeric tool to compress the second cylindrical surface of the elastomeric tool against the powder metal.

2. A method as claimed in claim 1, wherein one surface of the elastomeric tool is restrained, the opposite surface is against the powder metal, and a surface perpendicular to the opposite surface is compressed by a punch.

3. A method as claimed in claim 1, wherein the force applied to the elastomeric tool causes the elastomeric tool to expand radially to compress the powder metal compact radially.

4. A method as claimed in claim 1, wherein the elastomeric tool has a contoured surface in the axial direction to compensate for variations in radial expansion in the elastomeric tool along the axial direction when the elastomeric tool is axially compressed.

5. A method as claimed in claim 1, further comprising sintering the powder metal compact to form a sintered component and wherein the sintered component is shaped as an internal combustion engine cylinder liner sleeve.

6. A method as claimed in claim 5, further comprising insert casting the sintered component into a cylinder of an internal combustion engine.

7. A method as claimed in claim 1, further comprising:

providing an inner punch and an outer punch, one of the inner punch and the outer punch having an inside diameter and an outside diameter corresponding to an inside diameter and an outside diameter of the powder metal compact;

wherein the step of compressing the powder metal to form the powder metal compact includes:

axially moving the inner punch and the outer punch to compress the elastomeric tool and the powder metal; and moving one of the inner punch and the outer punch to decompress the elastomeric tool while keeping the other of the inner punch and the outer punch in contact with the powder metal compact to prevent damage to the powder metal compact.

8. A method as claimed in claim 7, wherein the inner punch and the outer punch are on the same side of the powder metal compact.

9. A method as claimed in claim 7, wherein the inner punch and the outer punch are flush with one another at the initiation of compaction.

10. A method as claimed in claim 7, wherein, prior to compaction, the annular space into which powder metal is filled overlaps inner punch and the outer punch.

11. A method as claimed in claim 1, wherein the compaction die tool set includes a punch having a first piece and a second piece, the first piece is inserted into the annular space into which the powder metal is filled to seal the top of the space and the second piece compresses the elastomeric tool to compress the powder metal in the annular space.

12. A method as claimed in claim 11, wherein the second piece compresses the elastomeric tool at an end of the tool.

13. A method as claimed in claim 11, wherein the force exerted on the elastomeric tool by the second piece is relieved prior to withdrawal of the first piece from the annular space.

14. A method as claimed in claim 11, wherein the first piece is inserted into the annular space to substantially the height of the powder metal compact without substantial compression of the powder metal in the annular space.

15. A method as claimed in claim 1, wherein the compaction die tool set includes a plurality of collet sections and a collet, the collet sections being between the elastomeric tool and the collet, with mating surfaces on the collet sections and the collet so that as the collet is forced axially onto the collet sections, the collet sections cam on the mating surfaces of the collet to compress a cylindrical surface of the elastomeric tool against the elastomeric tool so as to compress a cylindrical surface of the powder metal compact with the elastomeric tool squeezed between the collet sections and the powder metal compact.

16. A method as claimed in claim 15, wherein the collet sections compress an exterior cylindrical surface of the elastomeric tool.

17. A method as claimed in claim 15, wherein the elastomeric tool compresses an exterior cylindrical surface of the powder metal compact.

18. A method as claimed in claim 1, wherein the powder metal compact is a cylinder liner for an internal combustion engine.

19. A method as claimed in claim 1, wherein the powder metal compact has a matte finish resulting from compaction of the surface against the elastomeric tool.

* * * * *